United States Patent [19]

Acosta, Sr.

[11] Patent Number: 4,763,680

[45] Date of Patent: Aug. 16, 1988

[54] ADJUSTABLE CRUTCH WITH S-CURVE

[76] Inventor: Adam Acosta, Sr., 68 Connoley Cir., Chula Vista, Calif. 92011

[21] Appl. No.: 121,067

[22] Filed: Nov. 16, 1987

[51] Int. Cl.[4] ..... A61H 3/02

[52] U.S. Cl. ..... 135/68; 135/69; 135/74

[58] Field of Search ..... 135/68, 69, 71, 72, 135/74

[56] References Cited

U.S. PATENT DOCUMENTS

| | | | |
|---|---|---|---|
| 1,184,575 | 5/1916 | Saylor | 135/68 |
| 1,666,757 | 4/1928 | Snyder | 135/112 |
| 2,388,778 | 11/1945 | Wheeler | 135/68 |
| 2,490,380 | 12/1949 | Schweppenheiser | 135/68 |
| 2,741,255 | 4/1956 | Neptune | 135/72 |
| 3,213,870 | 10/1965 | Kiehn | 135/68 |
| 3,710,807 | 1/1973 | Ferry | 135/68 |
| 3,886,962 | 6/1975 | Damontis | 135/69 |
| 4,253,478 | 3/1981 | Husa | 135/68 |
| 4,291,715 | 9/1981 | Monte | 135/68 |
| 4,625,743 | 12/1986 | Harker | 135/68 |

*Primary Examiner*—Henry E. Raduazo

*Attorney, Agent, or Firm*—Ralph S. Branscomb

[57] ABSTRACT

A crutch is provided which is specifically designed for use by people who are overweight, or have scoliosis (a curvature of the spine condition), there being an S-curve defined in the upper portion of the crutch so that the crutch will confortably fit into the underarm and yet bend out and continue downward spaced further out laterally from the body so that the hip of an overweight person or a person with scoliosis is detoured by the crutch. The crutch is made hinged and collapsible so that it is easier to store and transport to offset the slightly more cumbersome shape of the crutch because of the incorporation of the S-curve. The crutch also features three point adjustability so that the overall length of the crutch, and its length between the S-curve and underarm support, and between the handgrip and the ground and the handgrip and the underarm are independently adjustable.

3 Claims, 1 Drawing Sheet

ADJUSTABLE CRUTCH WITH S-CURVE

BACKGROUND OF THE INVENTION

The invention is in the field of crutches. Traditionally, crutches are almost uniformly standard in design. Whether they are made of wood or of aluminum, they have an A-shaped upper portion which converges down to a lower portion having an extended foot or leg which passes through the downwardly extended members and is usually adjustable to establish different heights for the underarm support of the crutch, defined at the top of the A-frame.

Although the standard crutch has been useful for a very long time, there are certain features of it that could stand improvement. First, a standard crutch is straight. It extends straight down from the armpit, past the handgrip portion, to the ground. Whereas this might be very functional for most people, in the event the person is very much overweight and has very wide hips, or has scoliosis, the crutch will extend from the underarm out at an angle that is too wide for maximum traction, lessening the effective support available to the person using the crutch.

Secondly, crutches are fairly awkward. It would be very desirable to have a crutch that would fold in two so that the crutch would collapse for transport in cars, etc.

SUMMARY OF THE INVENTION

The invention fulfills the above-stated needs and comprises a crutch with an upper portion which has an S-curve defined in it to pass out, and down laterally displaced from the hip so that it will avoid the hip of an overweight person or a person with scoliosis, and still extend down to meet the ground at an approximately orthogonal angle.

In keeping with the advantage provided by the S-shape, the crutch is triply adjustable. This is desirable because by the incorporation of the S-shape into the crutch, there are now three distances that may be varied. These are the distance from the underarm to the ground, the distance from the handgrip to the ground, and the distance from the S-curve to the ground. The triple adjustability makes these distances more or less independently adjustable from one another.

Lastly, the crutch is hinged in the middle and will fold upon itself for transport. Although this feature would of course be advantageous in any crutch, it is especially advantageous in the instant crutch because the S-shape not only makes the crutch somewhat more awkward when not in use, but is also provides an easy way in which the lower, leg portion can fold up and more or less nest inside the two support members of the upper part of the crutch.

DETAILED DESCRIPTION OF THE PREFERRED EMBODIMENT

Figure 1:
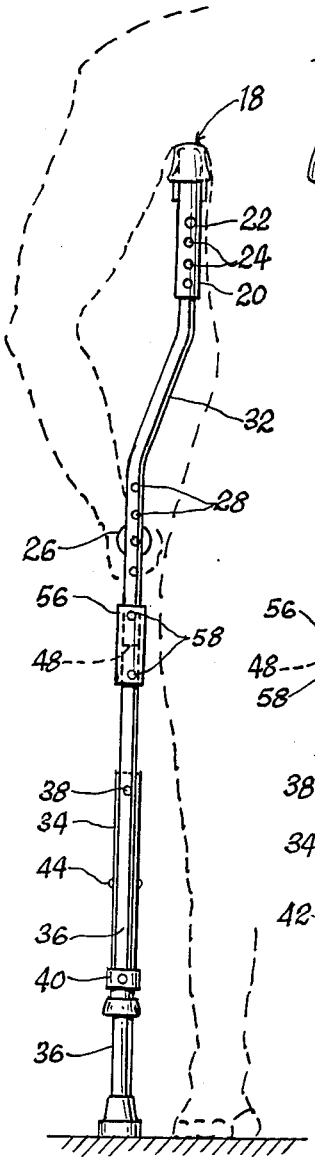
FIG. 1 is a front elevation view of a person, in phantom, using the crutch and showing the crutch in a side elevation.
Figure 2:
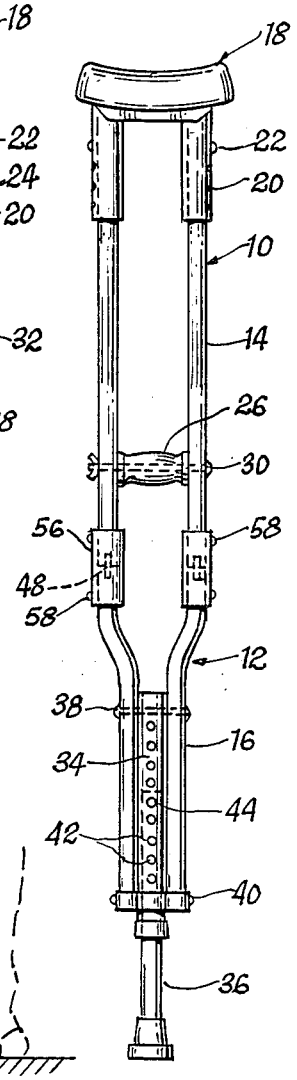
FIG. 2 is a front elevation view of the crutch.

The crutch has an upper portion 10 and a lower portion 12, each comprising a pair of tubular members 14 and 16, respectively. The upper tubular members 14 extend up to the underarm support member 18. The underarm support member has a pair of downwardly extending tubular sockets 20 which extend over the tops of the support members 14, and are secured to them by means of a pass-through bolts 22 which pass through the appropriate holes 24 defined in both the depending sockets 20 and the structural members 14 as best shown in FIGS. 1 and 2. Thus, the underarm support 18 is by itself vertically adjustable on the crutch.

Toward the lower ends of the support members 14 a handgrip 26 is defined therebetween. The handgrip is mounted to the supports 14 in much the same way as is the underarm support 18, that is, by means of a series of holes 28 defined in the support members 14, and a pass-through bolt 30. This structure, again, is best seen in FIGS. 1 and 2.

Defined in the structural members 14 between the underarm support and the handgrip is an S-curve 32, best shown in Figure 1. This curve, defined as it is by a pair of bends, has the result of defining a displacement in the lower portion of the crutch which is laterally outside of the underarm support. Thus, as shown in FIG. 1, the support to the underarm and the hand at the handgrip may be generally upwardly directed, and the crutch itself may meet the ground virtually perpendicularly, and at the same time, the hip of the user has been avoided as shown in FIG. 1. Thus, as the user walks, he is not constantly brushing the crutch against his hip, which can be very irritating over time.

The lower portion 12 of the crutch, defined by the support members 16, mounts a sleeve 34 therebetween which telescopically receives the leg 36. The sleeve is secured between the member 16 by a bolt 38 and a bolt through a bracket, indicated at 40. The leg 36 is retained at a certain one of the hole positions indicated at 42 by means of the detent buttons 44. Thus, the crutch is triply adjustable, with the underarm member being separately adjustable from the handgrip 26, and the leg 36 having its own adjustment. This is particularly related to the S-curve 32 because once the anatomy of the person has changed from the normal by means of obesity or scoliosis, the normal ratios betwen the parts are generally thrown off as well. As indicated above, the positioning of the S-curve may require adjustment semi-independently from the overall length of the crutch, and the overall distance between the handgrip and the ground.

The upper portion 10 of the crutch is hinged to the lower portion 12 of the crutch at the two hinged joints. These hinged joints have a hidden, internal hinge 48, which are pivotally connected into plugs 50, which are held in place in the tubular supports by means of pass-through rivets or bolts 52. These hinges are completely enclosed within the support members as shown in FIG. 3 when the crutch is linearly extended, and the pass-through slots 54 cut into the tubes for the purpose of passing the hinges therethrough as shown in FIG. 4, when the crutch is folded.

Figure 3:
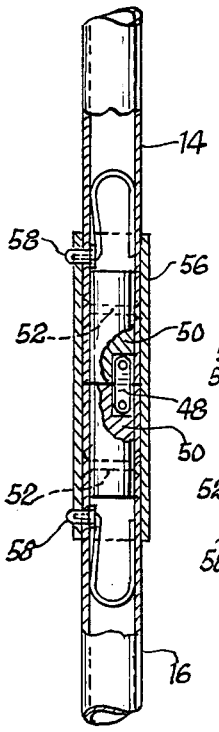
FIG. 3 is a detail, partially in section, of the hinged portion of the crutch.
Figure 4:
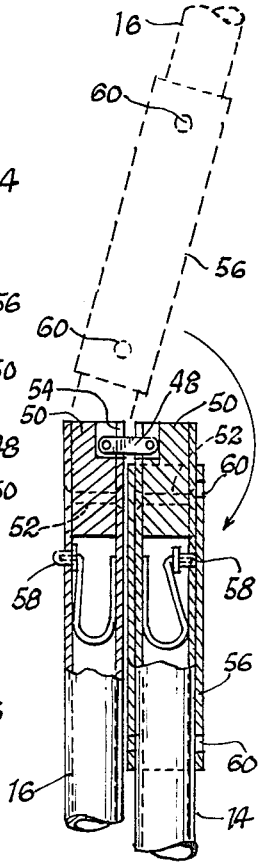
FIG. 4 illustrates the portion shown in FIG. 3 but with the crutch being folded.

Whereas the hinge permits the upper and lower portion of the crutch to fold relative to one another, an outer sleeve 56 slides through that position as shown in FIG. 3 over the hinge joint and maintaining the rigidity of the respective tubes, to a position clear of the hinge joint as shown in FIG. 4. When covering the hinge joint, it is maintained in place by means of a pair of spring-loaded buttons 58 which are contained within the tubular members and spring out through holes in the tubular members and through the holes 60 in the sleeve, as seen in Figure 4. The double button detent arrangement makes for a very secure, strong joint.

Figure 5:
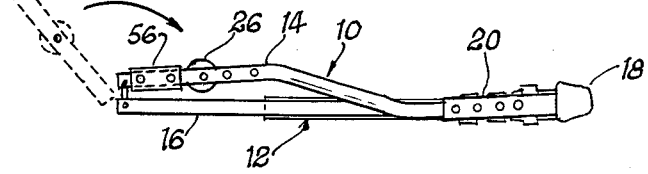
FIG. 5 illustrates the crutch in its entirety as it swings from its semi-extended position, in phantom, to its collapsed position.

As shown in FIG. 5, when the crutches collapse, the lower portion will fit between the two members of the upper portion if the length adjustment is correct. This enables the crutch to be folded more compactly, and tends to offset the somewhat bulkier configuration of the crutch caused by means of the incorporation of the S-curve into its design.

Although the crutch is mostly advantageous for those with a deviant hip shape or position, because of its collapsibility and multiple adjustability, it can be used by any person who needs a crutch, and the collapsibility feature of course can be beneficial to anyone who must transport the crutch in a small space.

I claim:

1. A crutch having:

(a) an upper portion;

(b) a lower portion extended from said upper portion; and, (c) said upper portion being comprised of a pair of spaced substantially parallel tubular support members with an underarm support passing across and between the tops thereof, said support members together extending down from said underarm support, each defining a first portion which is generally vertical in use, and each of said support members continuing downward from said first portion into a second portion which is deflected outwardly to clear the hip of the user, and continuing downwardly therefrom into a third portion which deflects back toward the user and is substantially vertical in use, parallel to said first portion.

2. Structure according to claim wherein said upper and lower portions are hinged together and move from an extended mode in use, to a collapsed mode for storage or transportation, and said lower portion when collapsed falls substantially between the parallel support members of the upper portion for compactness.

3. Structure according to claim 1 wherein said upper portion mounts a handgrip between the third portions of said support members so that the handgrip is mounted in a substantially vertical region of the upper portion of said crutch.

* * * * *